United States Patent [19]

Bozetto et al.

[11] Patent Number: 5,072,553

[45] Date of Patent: Dec. 17, 1991

[54] SHELL STRUCTURE FOR A COOLING TOWER

[75] Inventors: Pierre Bozetto, Saint Cyr au Mont d'Or; Jean-Marc Truchet, Amberieu en Bugey; Marcel Barret, Chazay d'Azergues; Guy, Chauvier Lyon, all of France

[73] Assignee: Electricite de France (Service National), Paris, France

[21] Appl. No.: 438,120

[22] Filed: Nov. 20, 1989

Related U.S. Application Data

[63] Continuation-in-part of Ser. No. 249,139, Sep. 26, 1988.

[30] Foreign Application Priority Data

Sep. 28, 1987 [FR] France ..... 8713375
Jun. 30, 1988 [FR] France ..... 8808833

[51] Int. Cl.[5] ..... B01F 3/04; E04B 1/32

[52] U.S. Cl. ..... 52/63; 52/80; 52/222; 52/245; 261/DIG. 11

[58] Field of Search ..... 52/80, 81, 245, 648, 52/83, 222; 261/DIG. 11

[56] References Cited

U.S. PATENT DOCUMENTS

| | | | |
|---|---|---|---|
| 2,914,074 | 11/1959 | Fuller | 52/83 |
| 3,006,670 | 10/1961 | Schmidt | 52/81 |
| 3,761,067 | 9/1973 | Marosi | 261/DIG. 11 |
| 4,010,580 | 3/1977 | Mayr | 52/80 |
| 4,060,575 | 11/1977 | Uhlirsch | 52/83 |
| 4,141,187 | 2/1979 | Graves | 52/173 R |
| 4,326,363 | 4/1982 | Leonhardt | 52/83 |
| 4,355,918 | 10/1982 | Vliet | 52/81 |
| 4,388,785 | 6/1983 | Queffelec | 52/81 |
| 4,437,288 | 3/1984 | Foissac | 52/648 |
| 4,480,418 | 11/1984 | Ventrella | 52/648 |

FOREIGN PATENT DOCUMENTS

| | | | |
|---|---|---|---|
| 0218542 | 4/1987 | European Pat. Off. . | |
| 586020 | 10/1933 | Fed. Rep. of Germany | 261/DIG. 11 |
| 2222516 | 10/1974 | France . | |

*Primary Examiner*—John E. Murtagh

*Attorney, Agent, or Firm*—Fleit, Jacobson, Cohn, Price, Holman & Stern

[57] ABSTRACT

A shell structure for constituting the airflow shaft of a water-cooling tower comprises an upright frame support by ground foundations. The frame consists of a grid having at least three intersecting sets of bars, one of the sets comprising horizontal bars connected as to constitute circumferential girdles vertically distributed along the frame while the other two sets comprises bars which are at opposed angles with said horizontal bars, for defining a grid whose elemental pattern is an equilateral triangle. The bars are connected by nodes each receiving bars of all said sets. A veil defining a substantially continuous airflow stack is located within said frame and maintained in tension by connectons to the nodes of the frame. The frame may have a constant cross-section while the veil has a cross-section which varies along the vertical axis of the structure.

11 Claims, 5 Drawing Sheets

SHELL STRUCTURE FOR A COOLING TOWER

CROSS-REFERENCES TO RELATED APPLICATION

This is a continuation-in-part of our co-pending U.S. Pat. application No. 249,139, filed Sept. 26, 1988.

BACKGROUND OF THE INVENTION

1. Technical Field

The invention relates to shell structures for cooling towers of the type comprising a framework resting on foundations and a wall carried by the framework and defining a stack. It is particularly suitable for use in the field of atmospheric cooling towers of power plants producing electricity.

2. Prior Art

Most of the atmospheric cooling towers existing at the present time are formed by a monolithic structure of reinforced concrete whose height may exceed 180 meters, supporting a network of ducts for dispersing the water to be cooled over an exchange lattice.

However, other constructions have also been proposed. In particular, structures have been proposed comprising a framework, often of metal, and a thin wall formed by panels of different materials, such as composites formed from an organic matrix and metal or concrete reinforcements. The panels are assembled together by mechanical means such as bolts.

The reliability of such structures depends on maintaining permanent supervision and results in high maintenance costs. In addition, the construction of the structures is time consuming and repairs are delicate.

A shell structure of the above-defined type has also been proposed (French 2,222,516) in which the framework is formed by meridian elements connected to circumferential elements by assembling nodes, air tightness being provided by a veil or thin wall. This construction requires complex mounting operations and a large number of different elements and however does not make it possible to design a shell of optimum shape from the aeraulic point of view.

SUMMARY OF THE INVENTION

It is an object of the invention to provide an improved shell structure for a cooling tower. It is a more specific object to provide a structure allowing a simple and relatively inexpensive manufacture having an air-duct of optimized shape.

For that purpose, there is provided a shell structure forming the stack of an atmospheric cooling tower, comprising a framework resting on foundations anchored in the ground and veil carried by the framework and defining a stack. The framework is formed by a treillis having three sets of bars, one of the sets being formed of horizontal bars so as to form hoops and the other two sets being formed of bars having opposite slants with respect to the vertical, so as to form a treillis with a substantially equilateral triangle shaped mesh, the bars being connected together by assembling nodes situated at the apexes of the triangle. The veil forms a continuous stack disposed inside the framework and stretched by connection to the latter.

Although it forms a continuous stack, the veil will generally be formed of sections, for example in the form of rings, connected together on site. The veil may be fastened to the nodes. By adjusting the length of the attachments connecting the veil to the nodes, it is possible to give to the veil a meridian section different from that of the treillis and optimized from the aeraulic point of view.

In a typical embodiment, the upstanding framework is formed by a treillis which is cylindrical in shape and has a constant cross-section. An optimum shape of the air passage is then obtained by giving different lengths to the attachments connecting the veil to the nodes. Such a structure has a particularly low cost since all bars and all nodes may be mutually identical and consequently the inventory is reduced and the construction is easier. The nodes need not be designed for angular freedom of the bars with respect to the nodes. The latter may consequently consist of solid balls formed with holes in which the end portions of the bars are secured by threading, bonding or press-fit.

Whatever the solution adopted for forming the veil, it will stop at a distance from the foundations so as to provide, at the bottom part of the structure, an air inlet passage when the structure forms the stack of an atmospheric exchanger. The bottom end of the veil may be fixed to a lintel fast with the framework. It is also possible to provide attachment at a variable level so as to obtain an adjustable flow cross-sectional area, depending particularly on the ambient temperature and/or the power at which the power plant equipped with the exchanger is operating.

Each of the assembling nodes between bars may comprise two coaxial flanges having means for drawing them together, each flange comprising at least two recesses spaced evenly about the axis and cooperating with the recesses of the other flange so as to form housings retaining end swellings or bulges of the bars.

The end bulges and the recesses may then have a shape making it possible to select the orientation of the bars, at least in a predetermined angular ring. To fulfil this condition, the end swillings must have a rotational symmetry as well as the housing which retains them, so as to provide a degree of freedom. In general, the end swellings will be in the form of a ball and the internal surfaces of the pockets will be in the form of a spherical cap having a diameter corresponding to that of the ball, within dimensioning tolerances.

The flanges are advantageously identical with each other, which reduces the number of different parts to be provided and in addition makes it possible to manufacture all the flanges in the same mold, when they are made from a molded material, for example from a composite material such as fiber reinforced resin.

BRIEF DESCRIPTION OF THE DRAWINGS

The invention will be better understood from the following description of a particular embodiment, given by way of example. The description refers to the accompanying drawings, in which.

DETAILED DESCRIPTION OF A PREFERRED EMBODIMENT

Figure 1:
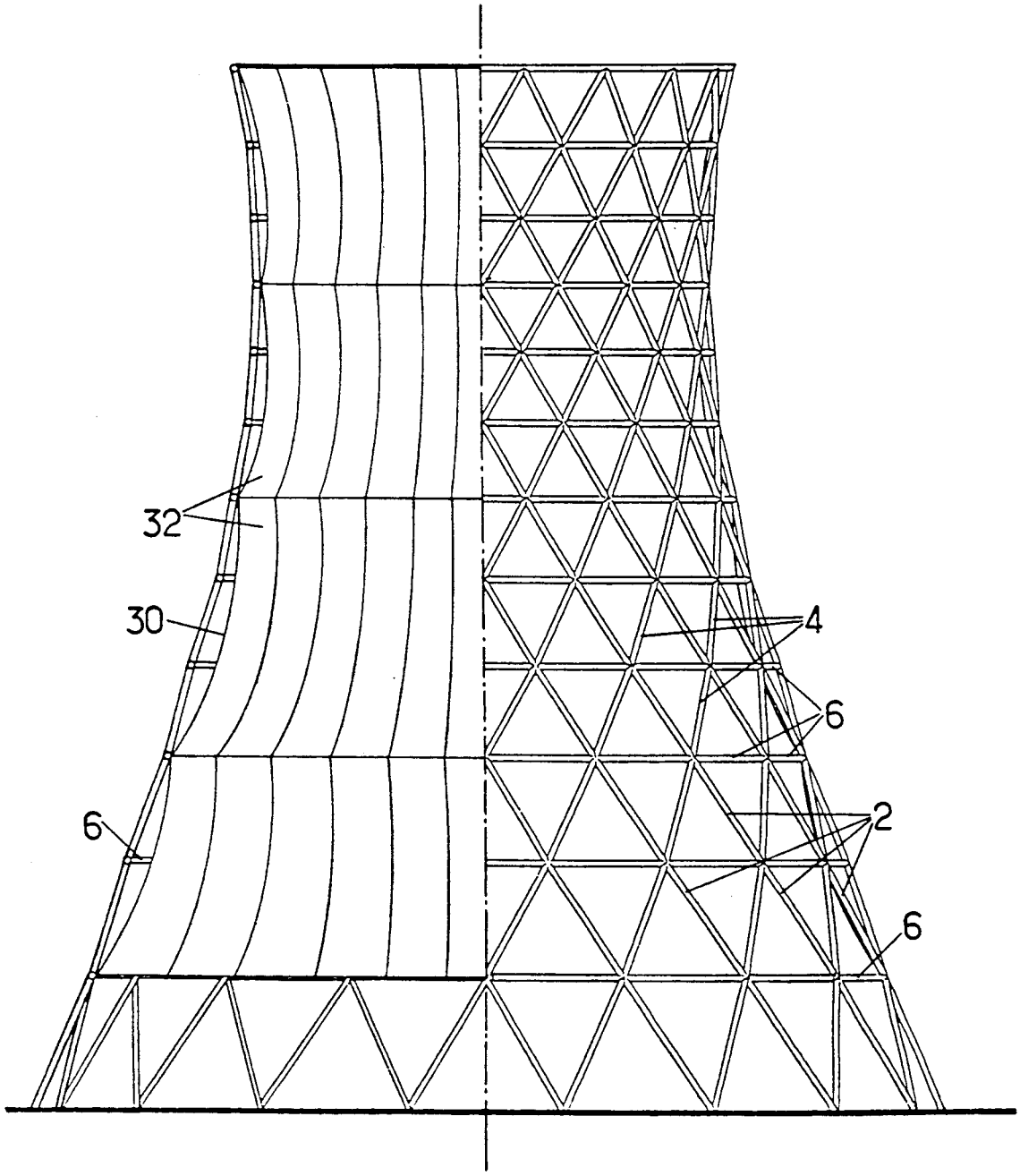
FIG. 1 is a schematic elevational view of the framework of a shell structure in accordance with the invention, for forming an atmospheric cooling tower (right hand part of the FIG.) and of the veil defining a stack (left hand part)

The structure shown schematically in FIG. 1 is intended to form the stack of an atmospheric cooling tower which may be of any type currently used at the present time (dispersion and/or dripping, crossed currents or countercurrent). The structure comprises a veil placed inside a framework which rests on foundations (not shown in FIG. 1) anchored in the ground and it is formed as a treillis or grid having two sets of oblique bars 2 and 4; the bars of one set have a slant opposite that of the bars of the other set with respect to the vertical, the slant being about 60° and depending on the geometry of the structure.

In each set, the bars are assembled in lines spaced evenly apart about the axis of the structure. A third set of bars 6 is formed of horizontal bars assembled as circumferential hoops or girdles and forming, with the other sets of bars, a lattice network having an approximately equilateral triangular mesh.

The bars may be connected together by assembling nodes having the construction shown in FIGS. 2 to 6, so that a node may receive six bars belonging to the sets 2, 4 and 6. It comprises two flanges 10 and 12 identical with each other and having a symmetry of revolution of order 6. Each flange is advantageously formed as a single piece made from a composite material, such as resin reinforced by glass or carbon fibers.

Each flange may be regarded as having a plate 14 whose peripheral part is curved so as to form recesses 16. The central portion of the plate merges with a projection 18 having a rotational symmetry, formed centrally with a bore for receiving an axial clamping bolt 20. The periphery of the plate is formed with holes 22 placed between the recesses 16 for receiving additional bolts 24. Bolts 20 and 24 form means for clamping the two flanges 10 and 12 together and clamping end bulges of the junction bars 8 between the flanges, as will be seen further on. Stiffening ribs 21 (FIGS. 2 and 6) advantageously connect the projection to the bottom wall of the recesses 16.

When the flanges 10 and 12 are placed in mutually confronting relation, two opposite recesses 16 form a housing retaining an end swelling 26 belonging to a bar 8. In the embodiment illustrated, designed for giving two degrees of freedom to the bar and thus allowing adjustment of the angular position of bar 8 in all directions, the internal surfaces of recesses 16 are in the form of a spherical cap, of a diameter corresponding to that of the bulges 26 in the form of a truncated ball, within the dimensioning tolerances. The dimensions of the opening of the housing and the diameter of bar 8 define the maximum angle a which the bar may assume with respect to the perpendicular to the axis of the node. In practice, an angle a of about 10° in all directions in space will generally be sufficient.

In the application of the invention to the construction of shell structures for atmospheric cooling towards, connecting bars 8 may often be used having a diameter of about 200 mm, from 2 to 3 mm in length. At the top of the shell, where the forces to be withstood are lower, certain hoops may be omitted.

Figure 3:
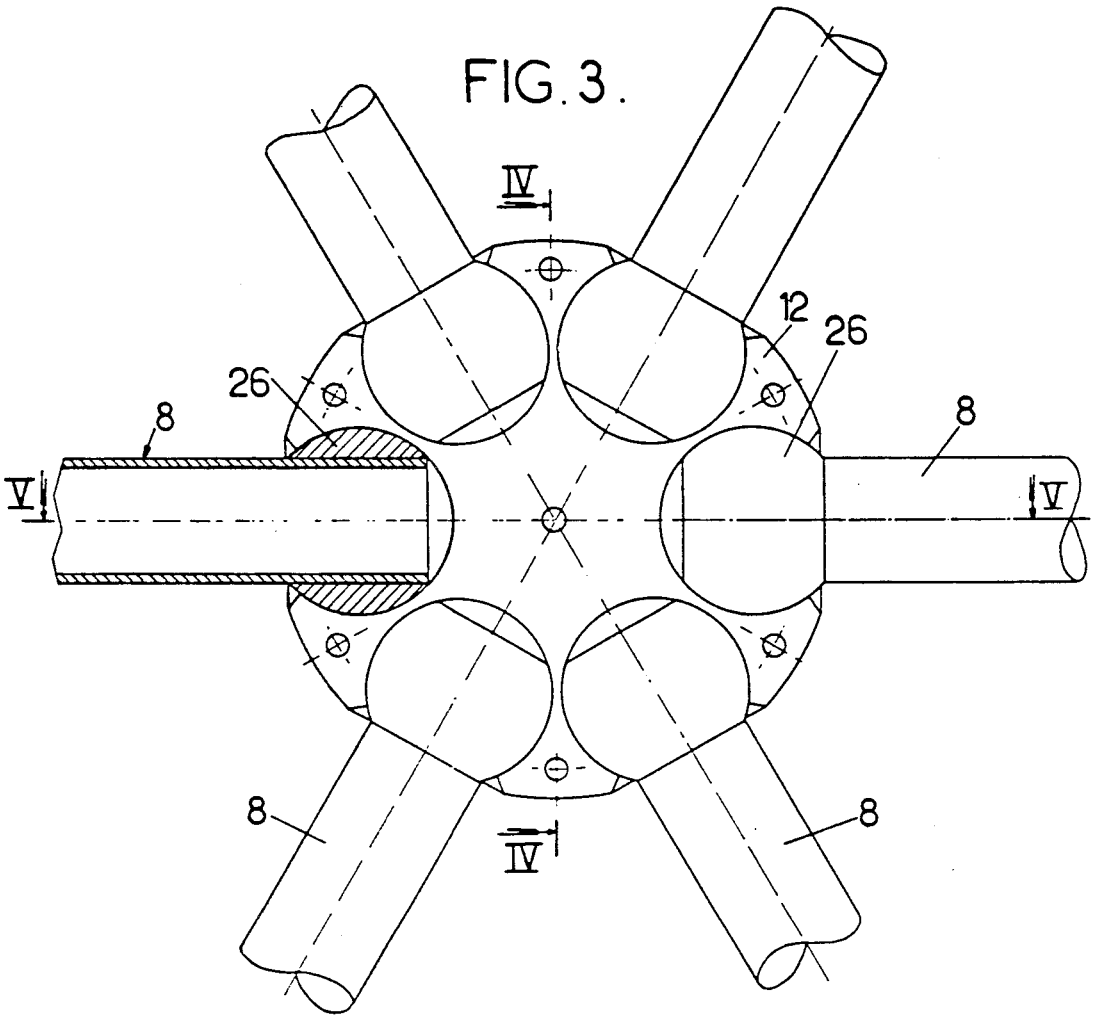
FIG. 3 is an elevational view of one of the flanges of the node of FIG. 2 and of the end portions of the bars which it receives, one of the bars being shown in cross-section through line III of FIG. 4.
Figure 6:
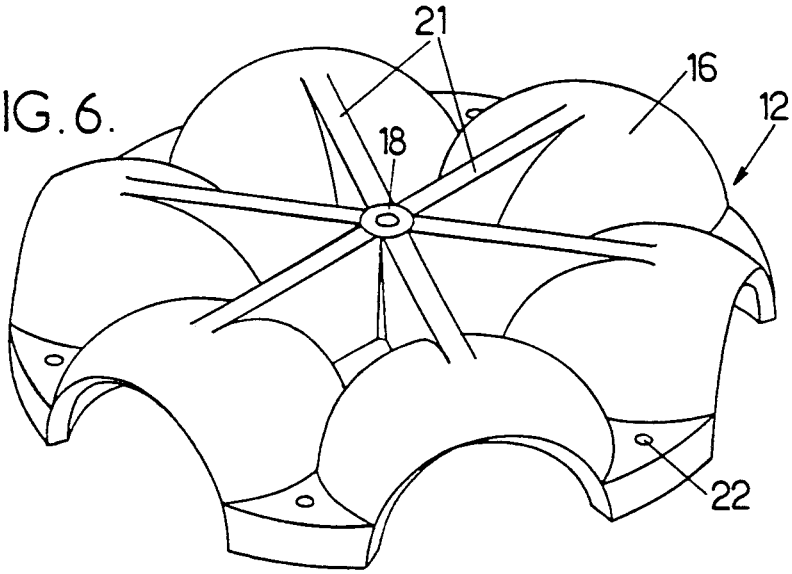
FIG. 6 is a perspective view of a flange of the node of FIG. 2.

Bars 8 may, like the flanges, be of a composite material (heat hardenable product reinforced by fibers). Bars may in particular be used made from two parts assembled together, more simple to manufacture. As shown in FIG. 3, each bar has a tubular beam section, formed for example by pultrusion, filament winding, mold injection, etc. and a ball 26 formed with a cylindrical hole and bonded to the beam section. By waiving the use of an identical cross-section for all bars (advantageous from the standardization point of view), the diameter and/or the thickness may be adapted to the forces supported at each level. The bars may have end bulges in the form of a ball having a diameter of 300 mm for example. For these bulge sizes, the flanges 10 and 12 may have a diameter of about 880 mm. The bars may be in the form of a tube having a thickness of 20 mm, formed from a heat hardenable matrix (polyester resin, epoxy or phenolic vinyl ester resin for example) containing a fibrous reinforcement filling (glass, carbon, aramide or metal fibers for example). The proportion of reinforcement filling will generally be of from 50 to 70% by weight. A composition of the same kind may be used for forming the flanges.

One and a same type of node may be used for forming spatial framework structures having a variable curvature.

Figure 5:
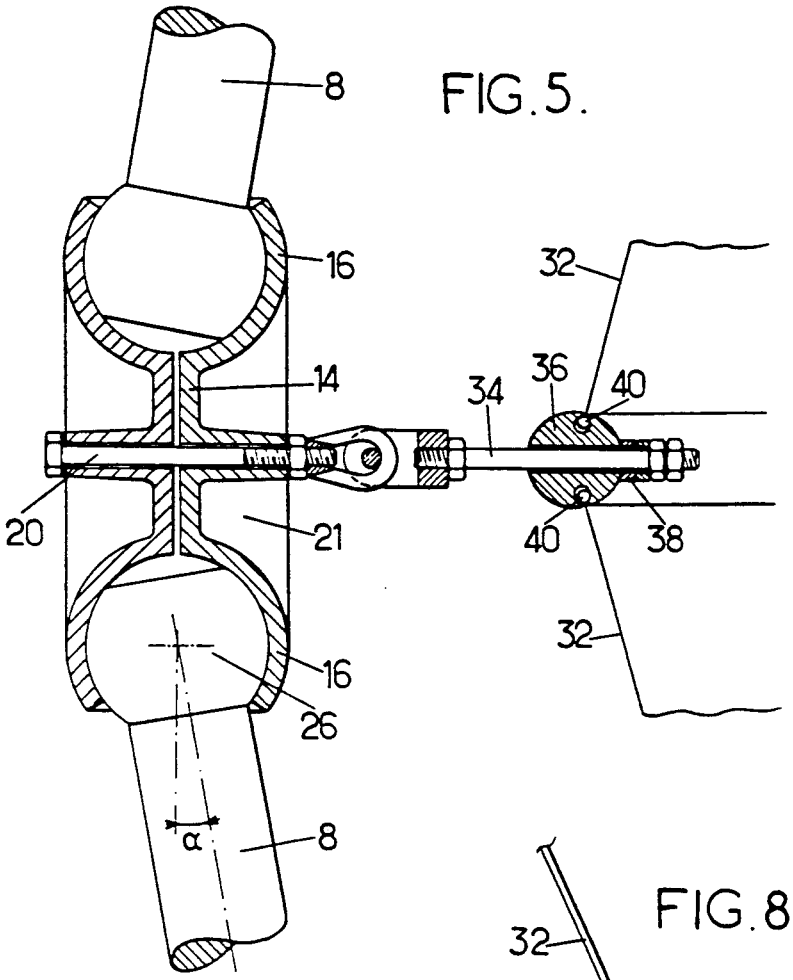

The air sealing veil 30 placed inside the framework forms a continuous flow guide stack. In the particular embodiment shown in FIG. 5, this veil is formed of several annular strips 32 whose edges are fixed to horizontal rows of nodes by substantially air tight connection means. As illustrated in FIG. 5, the connection between a node and two successive strips 32 comprises a link 34 articulated with the corresponding bolt 20 and having a connecting belt joint 36. The position of belt joint 36 on link 34 is adjustable by means of nodes 38, which makes possible to adjust the form and the tension of strips 32. These strips have terminal beads 40 imprisoned in grooves in the belt joints.

This arrangement makes it possible to give the stack a form slightly different from that of the framework and so to optimize the law of variation of the cross-sectional flow area along the structure.

The veil will generally be formed by weaving threads of plastics materials such as polyesters to form a cloth, then coating with thermo-plastic or thermohardenable materials for waterproofing the cloth.

The veil does not extend downwards beyond the lower row of bars 6, so as to leave a free air inlet passage. It is possible to provide an additional cloth strip, weighted so as to be stretched, and which may be unwound to a greater or lesser extent below the lower row of bars 6 so that the flow section may be adjusted.

Figure 8:
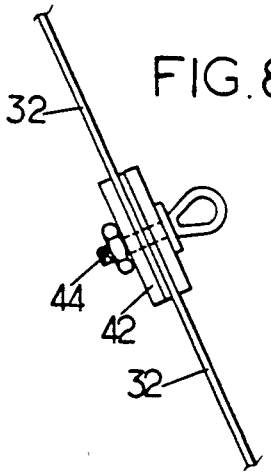
FIG. 8 is a diagram showing a modified connection between strips,. forming the veil.
Figure 7:
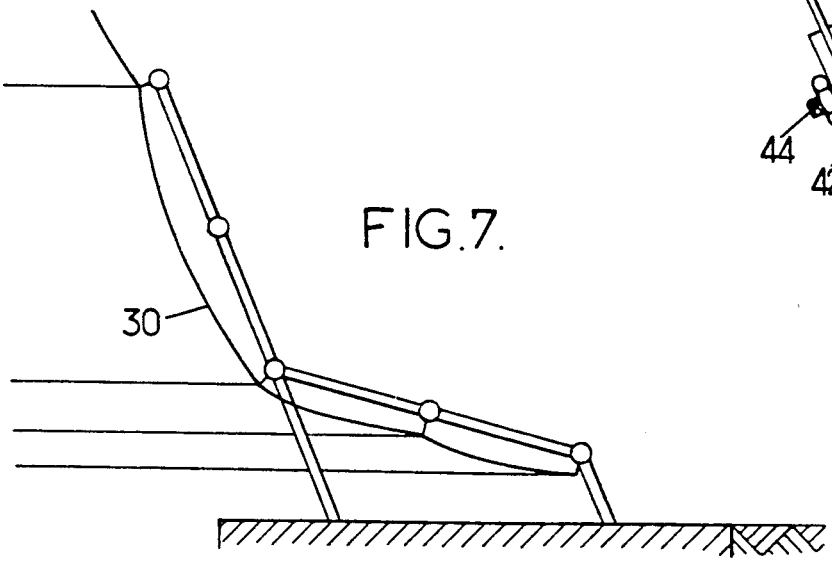
FIG. 7 is a diagram, similar to a fraction of the left hand part of FIG. showing a modification.

Numerous embodiments of the framework are possible. It may be doubled, in the zones withstanding particular high forces, by connecting two nodes together by means of bolts 20 of great length. So as to be able to adopt a section through a meridian plane opening out widely towards the bottom, it is possible to provide a fork construction of the framework of the bottom part, as shown schematically in FIG. 7. It is also possible to use veil structures different from those shown in FIG. 5 by using strips 32 connected together on the site by means of cover plates 42 clamped by bolts 44 ending in an articulated connecting eyelet as shown in FIG. 8.

Figure 2:
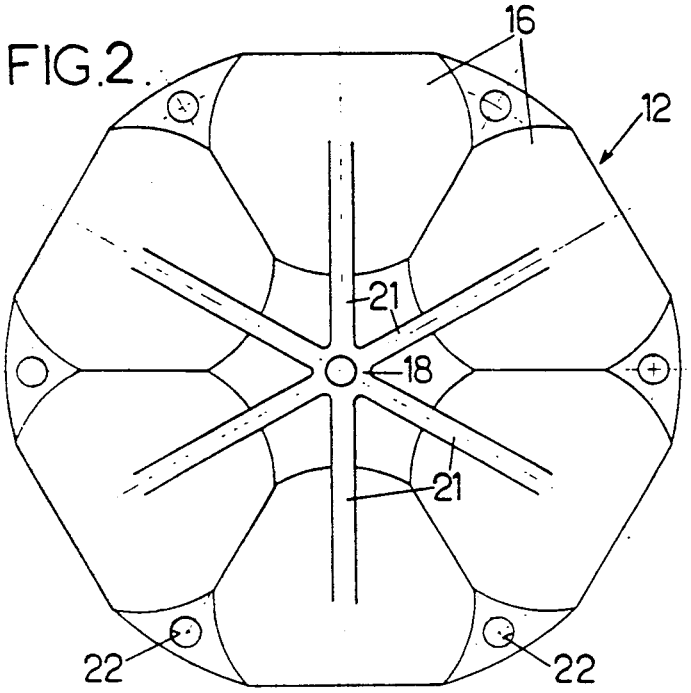
FIG. 2 is an elevational view of an assembling node which can be used for forming the framework of FIG. 1, comprising six reception housings for forming triangular or hexagonal lattice structures.
Figure 9:
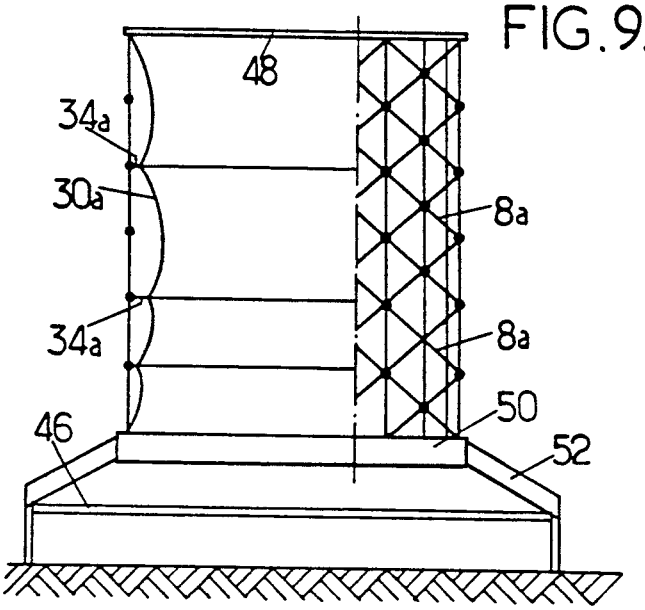
FIG. 9 is a diagram illustrating another modified embodiment, the right-hand portion of the FIG. illustrating the external aspect of the treillis and the left hand portion being a cross-section along an axial plane.

Referring to FIG. 9, where the elements corresponding to those of FIGS. 1 and 2 are designated by the same reference numeral with a a affixed thereto, the structure has a framework with a circular cross-section having the same area throughout its height. An advantage of such a cylindrical framework is that all bars 8*a* and all assembling nodes may be mutually identical. The shape of the stack is defined by appropriate adjustment of the length of the individual links 34. The shape may be optimized as regards the air draught. The area of the heat exchange structure 46, for a same size of the structure may be increased. The stack may have a shape which differs from the conventional hyperboloid shape, which is currently used on the concrete atmospheric coolers for easier manufacture; however, it will retain the usual convergent-divergent shape.

The cylindrical shape illustrated in FIG. 9 is of substantial advantage for construction of the framework from the ground. The upper ring 48 may be manufactured by assembling individual sections on the ground. Then it is lifted with jacks. A first horizontal row of bars is fixed to the ring and receives the respective assembling nodes. The jacks are again actuated for further lifting the assembled portion. They are substituted with pillars and their points of action are modified. The process is repeated in the same way until the lower ring 50 is assembled. Then the lower ring 50 and the lower portion is manufactured. When the structure is ready, the thermal exchange body 46 is assembled.

Figure 4:
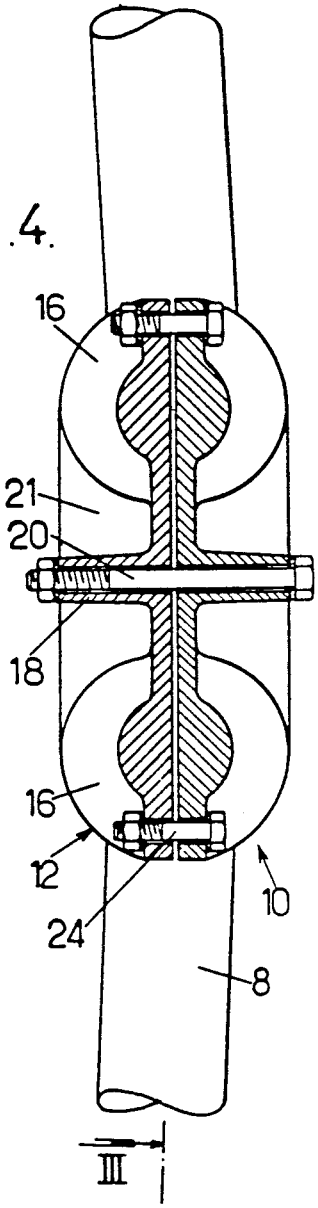
FIGS. 4 and 5 are sectional views through lines IV/IV and V/V of FIG. 3, showing the whole assembling node, FIG. 5 /showing in addition a type of attachments of the veil.
Figure 11:
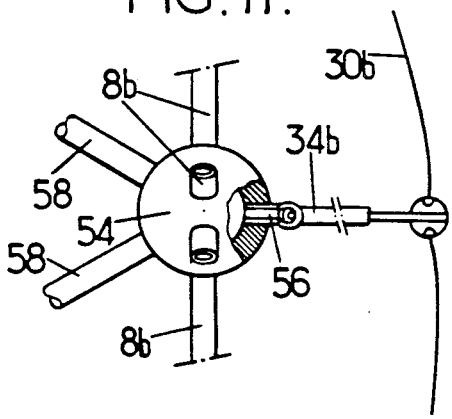
FIG. 11 is a schematic representation of an assembling node suitable for use in the framework of FIG. 10.
Figure 10:
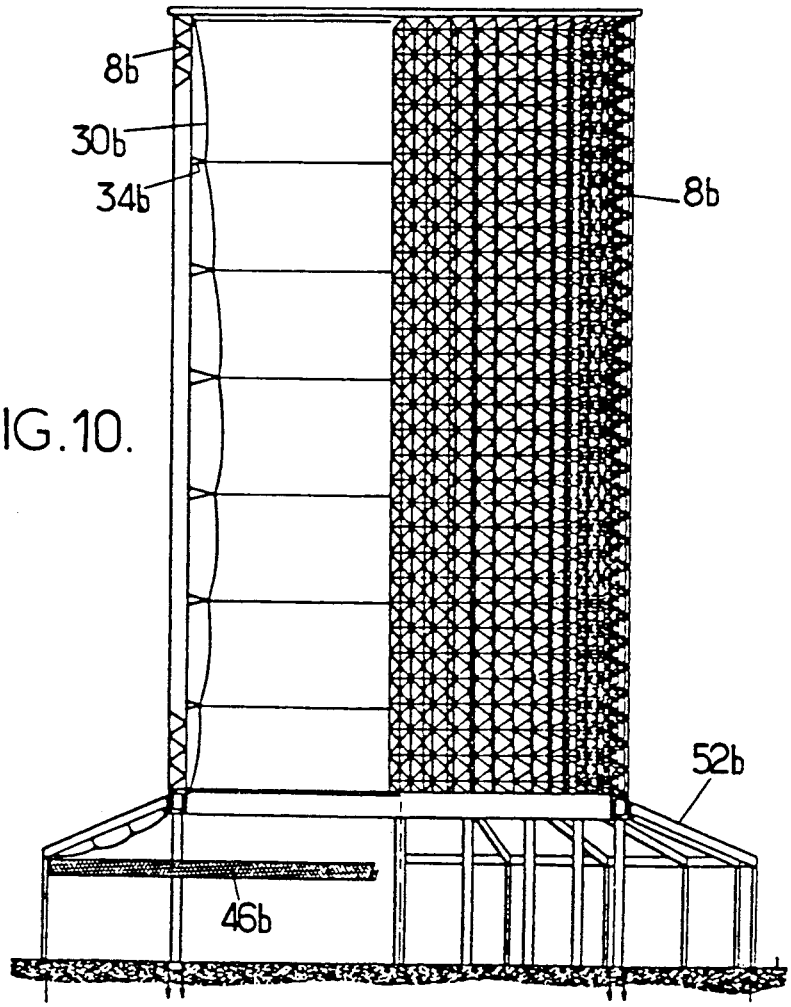
FIG. 10, similar to FIG. 9, is an illustration of still another embodiment, however with a cylindrical framework.

The structure shown on FIG. 10 differs from that of FIG. 4 only in that the framework has a spatial or tridimensional distribution of bars, rather than a bidimensional distribution. There are two mutually coaxial layers each consisting of bars disposed in a triangular array and bars connecting the two layers. The bars 8*b* are connected by assembling nodes arranged to receive a greater number of bars than in the embodiment of FIG. 9. As shown in FIG. 11, a node 54 consists of a hollow ball 54 formed with six holes for receiving respective bars 8*b*, for instance belonging to the radially inner layer and with a supplemental hole adapted to receive a stem of a fork 56 pivotally connected to link 34*b*. Two additional holes may receive bars 58 which connect the radially inner layer and the radially outer layer, for completing the spatial structure.

The number of coaxial layers may be different at different levels, the structure being spatial only in those zones which are subjected to maximum stresses, while it is bidimensionnal in the other zones.

Other solutions are further possible.

Due to the lightness of the structure thus formed, its manufacture may be undertaken simply from the ground, which overcomes the difficulties which the assembly of tubular bars represent at great height. The capping, held above the ground level by jacks, receives the highest bars. Then the assembly is periodically raised for fitting bars situated immediately below those which have been positioned. Thus framework assembling may be achieved in a simple way.

A modification consists in providing a central mast used for the different maintenance and monitoring requirements of the structure. It supports movable arms which may carry baskets, tools or any other maintenance apparatus required. In another modification, the veil is provided with wires, forming part of the structure or not, for passing an electro-heating current therethrough for defrosting or for avoiding the formation of ice.

The advantages of the invention are immediately apparent from reading the above description. They are particularly important in the case of structures of great height. It is possible to form structures much different from the hyperboloid conventionally adopted in the case of concrete atmospheric cooling towers. The mechanical strength at each level may be adapted to the forces to be withstood. The cost of a large height structure of the invention is much lower than that of an equivalent concrete structure. The assembling time is much lower. And finally, the repairs are much easier.

The internal structures of a cooling tower in accordance with the invention may be practically identical to those of cooling towers existing at the present time, which are moreover to a very large extent independent of the shell.

What is claimed is:

1. Cooling tower comprising:

an upright frame having a vertical axis supported by ground foundations, having three intersecting sets of bars defining a grid, one of the sets comprising substantially horizontal bars so located and connected as to constitute circumferential girdles vertically distributed along the frame while the other two sets comprises bars which are at angles with said horizontal bars, the bars of one of said other sets having an angle with the horizontal bars opposed to the angle of the bars of the other one of said two other sets, said bars being connected by assembling nodes each receiving bars belonging to all three of said sets and located at the nodal points of a substantially equilateral triangular network, said assembling nodes being distributed along a plurality of axially spaced horizontal rows;

an annular veil defining a substantially continuous airflow guide stack, located within said frame and approximately parallel thereto and having an opening into the atmosphere;

means for individually connecting said veil to only some of said nodes and maintaining said veil under tensile stress, said some of said nodes belonging to first ones of said rows which are separated by other ones of said rows which are separated from said veil and which are distributed throughout the axial length of the frame; and said annular veil including a plurality of vertically adjacent horizontal ring-shaped bands, and a separate connection means extending circumferentially within said frame for connecting adjacent bands and said separate connection means being secured to adjacent nodes in a horizontal plane.

2. Cooling tower according to claim 1, wherein said bars are of fiber-reinforced heat settable material.

3. Cooling tower according to claim 1, wherein each of said assembling nodes includes a pair of jaws mutually aligned along an axis and clamping means forcing said jaws toward each other along said axis, wherein each of said jaws has at least two recesses distributed at equal angular intervals about said axis and cooperating with respective recesses of the other jaw of the same assembling node for defining housings for receiving end bulges of respective ones of said bars.

4. Cooling tower according to claim 1, wherein each of said assembling nodes includes a pair of jaws retaining end bulges of said bars, the jaws of a same one of said nodes are mutually clamped by a bolt and said bolt is connected to said veil by a cascaded arrangement of a link having a universal connection with said central clamping bolt and of means fixed to said link and slidably receiving an edge of a respective one at least of said bands.

5. Cooling tower according to claim 1, wherein the veil is of synthetic material and includes wires for passing an electric heating current therein.

6. A cooling tower as claimed in claim 1, wherein said separate connection means is a joint belt.

7. A water cooling tower, comprising:

an annular upright framework having a rotational symmetry about a vertical axis, supported by ground foundations, consisting of at least three intersecting sets of bars which define a triangular network and are connected by assembling nodes distributed in successive vertically spaced rows;

a tubular veil defining a substantially continuous airflow stack and located within said frame and having a rotational symmetry about said vertical axis;

link means for connecting said veil to only some of said assembling nodes and maintaining said veil under tensile stress while the other ones of said assembling nodes are separated from said veil, said link means having mutually different lengths whereby said stack has a meridian cross-section different from the meridian cross-section of said frame; and said annular veil including a plurality of vertically adjacent horizontal ring-shaped bands, and a separate connection means extending circumferentially within said framework for connecting adjacent bands and said separate connection means being secured to adjacent nodes in a horizontal plane.

8. A water cooling tower as claimed in claim 7, wherein said separate connection means is a joint belt.

9. Water cooling tower according to claim 7, wherein said frame has a constant cross-section along and throughout said vertical axis, all said bars are mutually identical and all said nodes are mutually identical.

10. A cooling tower having a shell structure comprising:

an annular upstanding framework having a circular cross-section which is constant along a vertical axis, supported by ground foundations, consisting of intersecting sets of mutually identical bars connected by mutually identical assembling nodes distributed in successive vertically-spaced circular rows, a tubular veil defining a substantially continuous vertical airflow stack, located within said frame and having a rotational symmetry about said axis, link means connecting the framework to points of said veil distributed along circular lines at a mutual axial distance greater than the distance between successive ones of said rows, the link means connected to one circular line having a common length and said common length being different from the lengths of the link means in other ones of said circular line, whereby said tubular veil is given a shape defining a convergent-divergent airflow passage.

11. Cooling tower according to claim 10, wherein said mutually identical bars are distributed in two mutually coaxial layers of said bars disposed in a triangular array and additional said bars connecting the two layers.

* * * * *